US009851661B1

(12) United States Patent
Nakamoto et al.

(10) Patent No.: US 9,851,661 B1
(45) Date of Patent: Dec. 26, 2017

(54) FIXING DEVICE AND IMAGE FORMING APPARATUS

(71) Applicant: FUJI XEROX CO., LTD., Tokyo (JP)

(72) Inventors: Hiroki Nakamoto, Yokohama (JP); Masao Ito, Yokohama (JP); Yoshiya Imoto, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/353,240

(22) Filed: Nov. 16, 2016

(30) Foreign Application Priority Data

Jun. 24, 2016 (JP) ..... 2016-125075

(51) Int. Cl.
*G03G 15/20* (2006.01)

(52) U.S. Cl.
CPC ..... *G03G 15/2007* (2013.01)

(58) Field of Classification Search
CPC ..... G03G 15/2007
USPC ..... 399/336
See application file for complete search history.

(56) References Cited

U.S. PATENT DOCUMENTS 3,649,808 A * 3/1972 Garbe ..... G03G 15/2007 219/216
7,720,420 B2 * 5/2010 Kajita ..... G03G 15/2053 399/320
2016/0026122 A1 * 1/2016 Matsubara ..... G03G 15/2007 399/336

FOREIGN PATENT DOCUMENTS

JP 05341685 A * 12/1993
JP 2009204955 A * 9/2009
JP 2011-128223 A 6/2011

* cited by examiner

*Primary Examiner* — Susan Lee
(74) *Attorney, Agent, or Firm* — Sughrue Mion, PLLC

(57) ABSTRACT

A fixing device includes: an optical system that includes a lens serving as a light guiding path and concentrates laser light for image fixing at an interface between the lens and a recording material; a holding part that holds the lens of the optical system; an operating part that rotates together with the holding part; and a suppressing unit that suppresses propagation of energy of the laser light from the holding part to the operating part.

5 Claims, 5 Drawing Sheets

FIXING DEVICE AND IMAGE FORMING APPARATUS

CROSS REFERENCE TO RELATED APPLICATIONS

This application is based on and claims priority under 35 USC §119 from Japanese Patent Application No. 2016-125075 filed Jun. 24, 2016.

BACKGROUND

Technical Field

The present invention relates to a fixing device and an image forming apparatus.

Related Art

In recent years, a laser fixing system has been suggested for image forming apparatuses.

SUMMARY

According to an aspect of the present invention, there is provided a fixing device including: an optical system that includes a lens serving as a light guiding path and concentrates laser light for image fixing at an interface between the lens and a recording material; a holding part that holds the lens of the optical system; an operating part that rotates together with the holding part; and a suppressing unit that suppresses propagation of energy of the laser light from the holding part to the operating part.

BRIEF DESCRIPTION OF THE DRAWINGS

An exemplary embodiment of the present invention will be described in detail based on the following figures, wherein:

FIG. 4A shows a second configuration example; and FIG. 4B shows a third configuration example; FIG. 5A shows a fourth configuration example; FIG. 5B shows a fifth configuration example; and FIG. 5C shows a sixth configuration example.

DETAILED DESCRIPTION

Hereinafter, an exemplary embodiment according to the present invention will be described in detail with reference to attached drawings.

Figure 1:
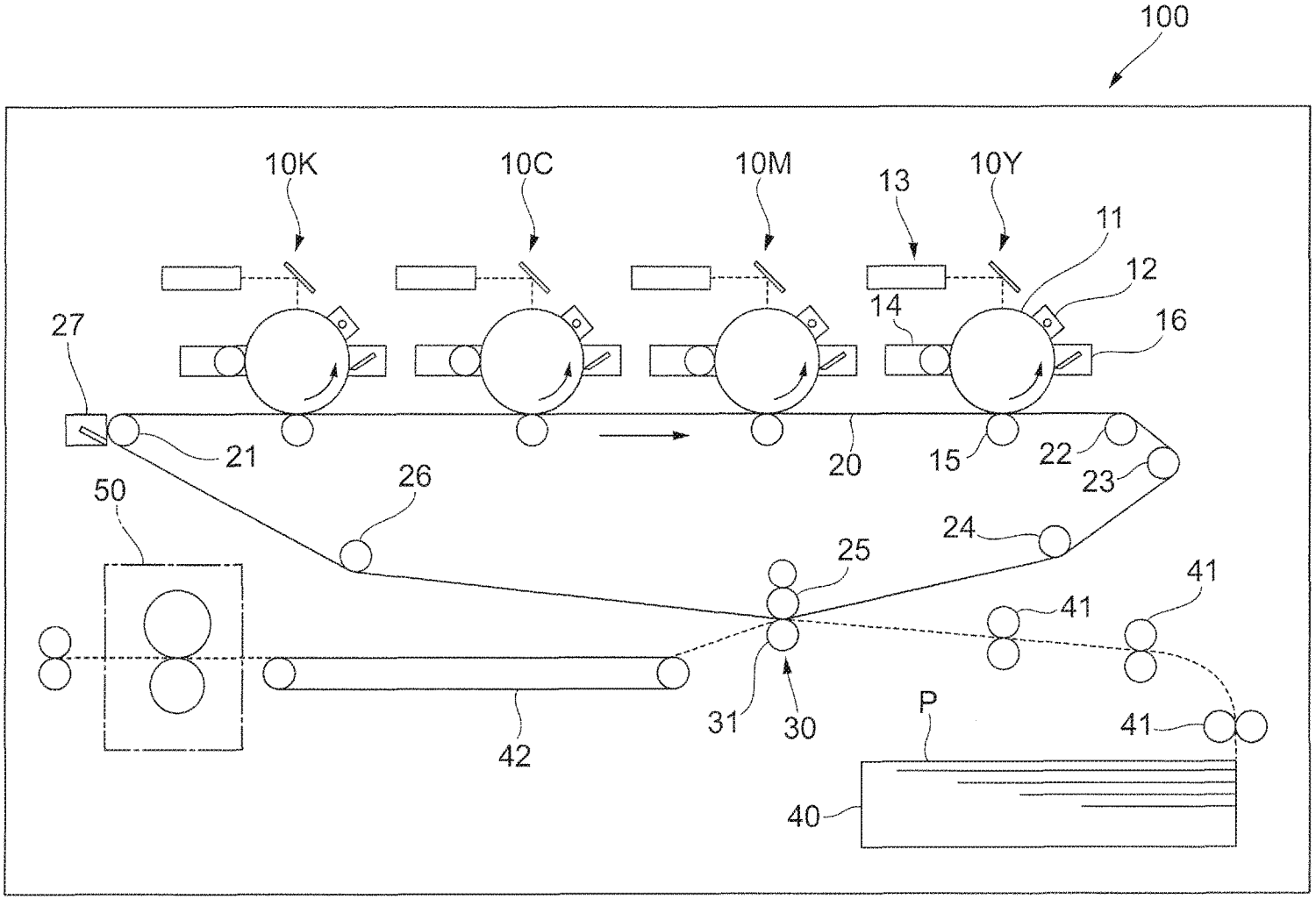
FIG. 1 is a diagram showing an image forming apparatus, to which the exemplary embodiment is applied, when viewed from a front side.

FIG. 1 is a diagram showing an image forming apparatus 100, to which the exemplary embodiment is applied, when viewed from a front side.

The image forming apparatus 100 shown in the figure has a configuration of a so-called tandem type and includes plural image forming units 10 (10Y, 10M, 10C and 10K) for forming toner images of respective color components by the electrophotographic system. Moreover, the image forming apparatus 100 according to the exemplary embodiment is provided with a controller that is configured to include a CPU (Central Processing Unit), a ROM (Read Only Memory), a RAM (Random Access Memory) and others, to thereby control operations of each device and each part constituting the image forming apparatus 100.

The image forming units 10 are an example of an image forming unit.

Moreover, the image forming apparatus 100 includes an intermediate transfer belt 20 to which the toner images of the respective color components formed in the respective image forming units 10 are sequentially transferred (primary transfer) and which holds the toner images of the respective color components, and a secondary transfer device 30 that collectively transfers (secondary transfer) the toner images of the respective color components on the intermediate transfer belt 20 onto a recording material P formed in a rectangular shape. The recording material P is a medium on which fixing is performed, such as paper, film, or the like.

The intermediate transfer belt 20 and the secondary transfer device 30 are an example of a transfer unit.

Moreover, the image forming apparatus 100 is provided with a sheet feeder 40 that feeds the recording material P. Moreover, between the sheet feeder 40 and the secondary transfer device 30, plural transport rolls 41 for transporting the recording material P positioned on a sheet transport route are provided.

Moreover, in the exemplary embodiment, a fixing device 50 that fixes the image having been secondarily transferred onto the recording material P by the secondary transfer device 30 onto the recording material P is provided. Further, between the secondary transfer device 30 and the fixing device 50, a transport device 42 that transports the recording material P having passed through the secondary transfer device 30 to the fixing device 50 is provided.

The fixing device 50 is an example of a fixing unit.

Here, each of the image forming units 10 functioning as part of the image forming part includes a photoconductive drum 11 that is rotatably attached. Moreover, around the photoconductive drum 11, there are provided a charging device 12 that charges the photoconductive drum 11, an exposure device 13 that exposes the photoconductive drum 11 to write an electrostatic latent image, and a developing device 14 that visualizes the electrostatic latent image on the photoconductive drum 11 with toner. Further, there are provided a primary transfer device 15 that transfers the toner images of the respective color components formed on the photoconductive drum 11 onto the intermediate transfer belt 20, and a drum cleaner 16 that removes residual toner on the photoconductive drum 11.

The intermediate transfer belt 20 is provided to be disposed on plural roll members 21, 22, 23, 24, 25 and 26 to be rotated. Of these roll members 21 to 26, the roll member 21 is configured to drive the intermediate transfer belt 20. Moreover, the roll member 25 is provided to face the secondary transfer roll 31 with the intermediate transfer belt 20 being interposed therebetween; accordingly, the secondary transfer device 30 is configured with these secondary transfer roll 31 and roll member 25.

Note that, at a position facing the roll member 21 with the intermediate transfer belt 20 being interposed therebetween, a belt cleaner 27 that removes residual toner on the intermediate transfer belt 20 is provided.

Figure 2:
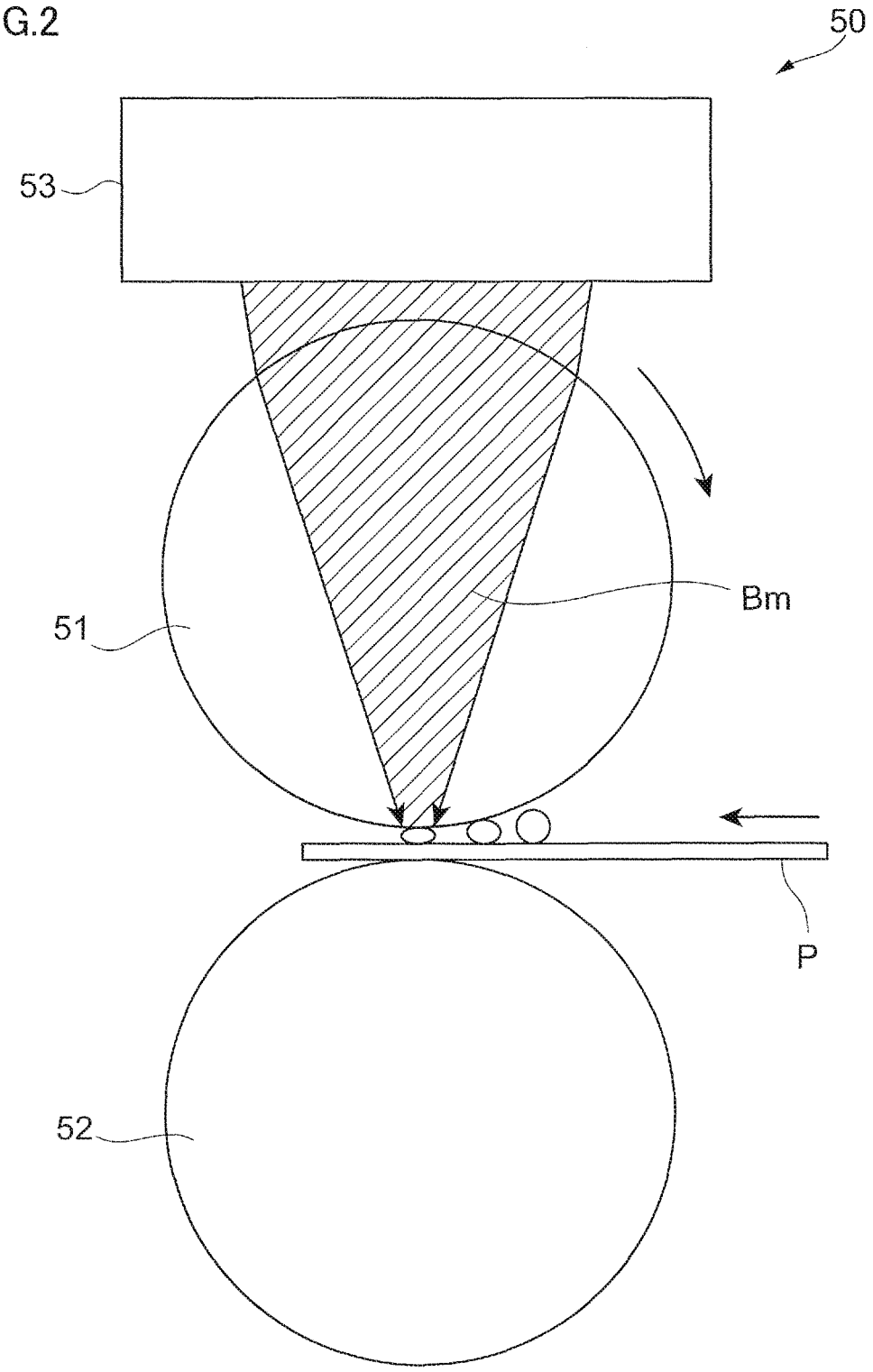
FIG. 2 is a diagram illustrating an outline configuration of a fixing device.
Figure 3:
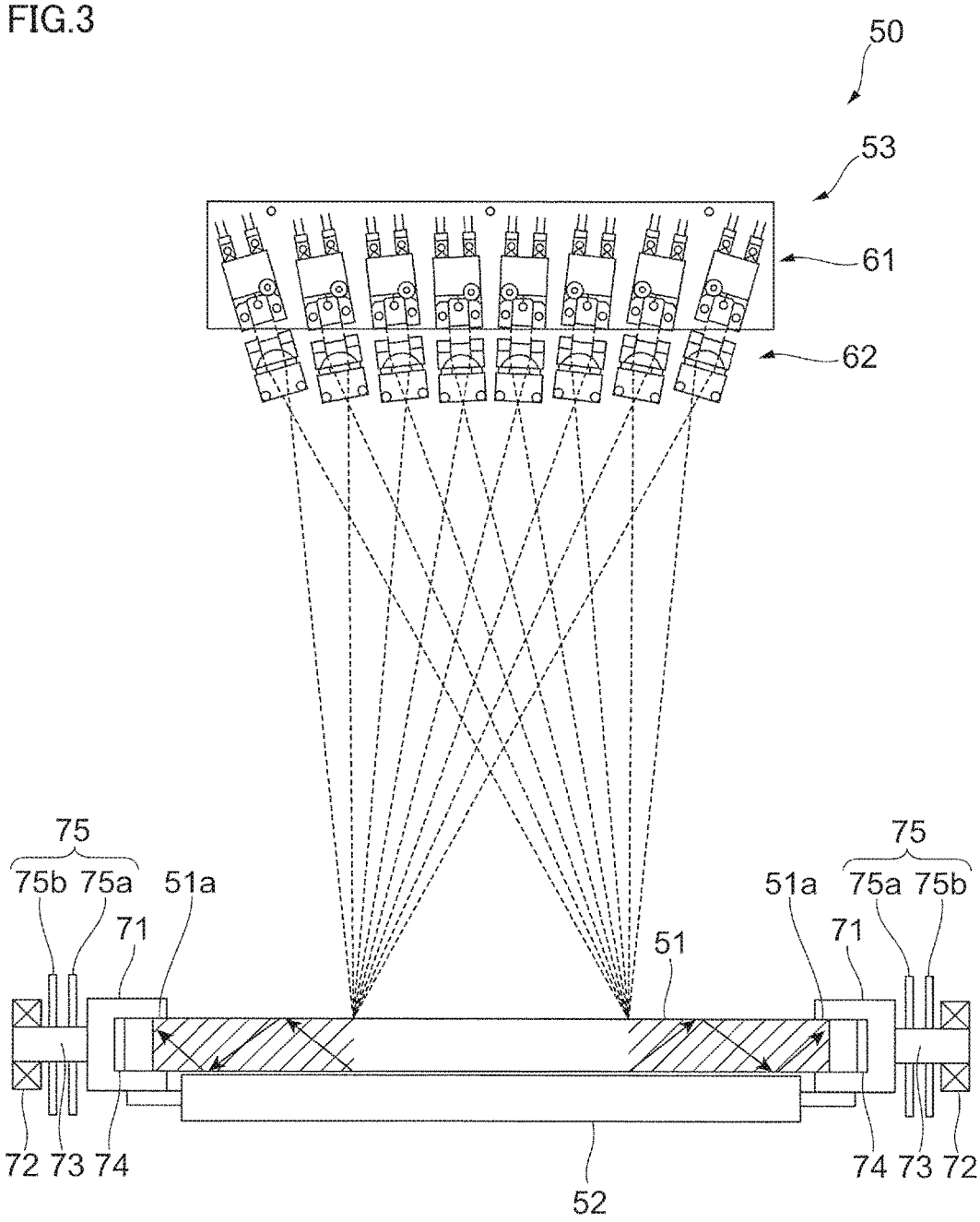
FIG. 3 is a diagram illustrating an outline configuration of a fixing device, and shows a first configuration example.

FIGS. 2 and 3 are diagrams illustrating outline configurations of the fixing device 50. FIG. 2 is a diagram as viewed from an edge side of a transparent rod 51, and FIG. 3 is a diagram as viewed from a circumferential surface side of the transparent rod 51. Moreover, FIG. 3 shows a first configuration example as an example of a suppressing unit.

As shown in FIG. 2, in the exemplary embodiment, the fixing device 50 includes a rotatable transparent rod 51 that is configured in a columnar shape with a transparent material capable of transmitting a beam Bm and a facing roll 52 that is provided to face the transparent rod 51 to form a contact area, the facing roll 52 cooperating with the transparent rod 51, to thereby transport the recording material P. Moreover, the fixing device 50 includes a light concentrator (linear light concentrator) 53 that causes laser light or the beam Bm, which is to be concentrated into a linear region extending over an entire width of a region (narrow light concentration width) of the recording material P onto which an image is transferred, to enter the transparent rod 51. The transparent rod 51 is an example of a lens.

The fixing device 50 is a laser fixing device that directly heats toner on the recording material P by the beam Bm from the light concentrator 53 concentrated in the linear region, to thereby perform melting-fixing. Note that, by narrowing the width of the linear region, light concentration efficiency is improved, and a fixing portion is rapidly cooled.

"Transparent" in the transparent rod 51 means high transmittance in a wavelength region of the beam Bm, which just has to transmit the beam Bm, and the higher the transmittance is, the better from a standpoint of light use efficiency or the like. For example, the transmittance may be 90% or more, and desirably, 95% or more.

Moreover, the facing roll 52 is configured with, for example, aluminum, stainless steel, a nickel-plated copper plate or others, and is disposed such that a predetermined pressurizing force is applied between the transparent rod 51 and the facing roll 52.

As shown in FIG. 3, the light concentrator 53 of the fixing device 50 is configured to include a laser stack 61 that emits beams Bm and an optical system 62 that concentrates the beams Bm from the laser stack 61. The optical system 62 concentrates the beams Bm to an interface between the transparent rod 51 and the recording material P. To additionally describe, the transparent rod 51 serves as a light guiding path when light concentration is performed by the optical system 62.

Note that the laser stack 61 is used in the exemplary embodiment; however, instead of the laser stack 61, it is possible to use a vertical cavity surface emitting laser unit, which is an areal light emitting array.

Both edges 51*a* of the transparent rod 51 are integrally held by respective holding parts 71. Moreover, bearings 72 that are positioned away from the edges 51*a* of the transparent rod 51 rotatably hold operating parts 73. Such operating parts 73 are formed to be connected to the holding parts 71. A driving force from a not-shown driving source is inputted to the operating part 73 of any one side of the respective edges 51*a* of the transparent rod 51, and the holding parts 71 and the operating parts 73 are subjected to rotation operation by such a driving force.

In this manner, due to rotation operation of the holding parts 71 together with the operating parts 73, the transparent rod 51 held by the holding parts 71 is rotated in one direction.

Note that, as the bearing 72, it can be considered to use a ball bearing, as well as to use a plastic bearing.

As shown in FIG. 3, between the edge 51*a* of the transparent rod 51 and the holding part 71, a heat absorbing part 74 that absorbs heat of light rays from the edge 51*a* of the transparent rod 51 is provided. In other words, the heat absorbing part 74 absorbs heat of the light rays (refer to arrows in the figure) having reached the edge 51*a* of the transparent rod 51 after entering the transparent rod 51 and repeating reflection of part or all thereof inside the transparent rod 51.

Moreover, at the holding part 71, there is provided a fin 75 that releases the heat absorbed by the holding part 74 to the outside. The fin 75 is configured to include multiple thin plate parts 75*a* and 75*b* extending from the holding part 71 toward the radial direction.

In the exemplary embodiment, since transfer of the heat of the light rays at the end portion of the transparent rod 51 from the holding part 71 to the bearing 72 via the operating part 73 is suppressed by the above-described heat absorbing part 74 and the fin 75, generation of bad effects to fixing performance by heat is prevented.

In the first configuration example, the heat absorbing part 74 has a function of absorbing heat of the light rays (heat absorption function), and the fin 75 has a function of suppressing temperature rising due to heat of the light rays (cooling function). The heat absorbing part 74 and the fin 75 are an example of a suppressing unit that suppresses propagation of energy of light rays to the operating part 73. The fin 75 is an example of an ejection part.

Here, various kinds of configuration examples other than the first configuration example in the exemplary embodiment will be described. In other words, other suppressing units formed by configurations other than the heat absorbing part 74 and the fin 75 will be described.

Figure 4A:
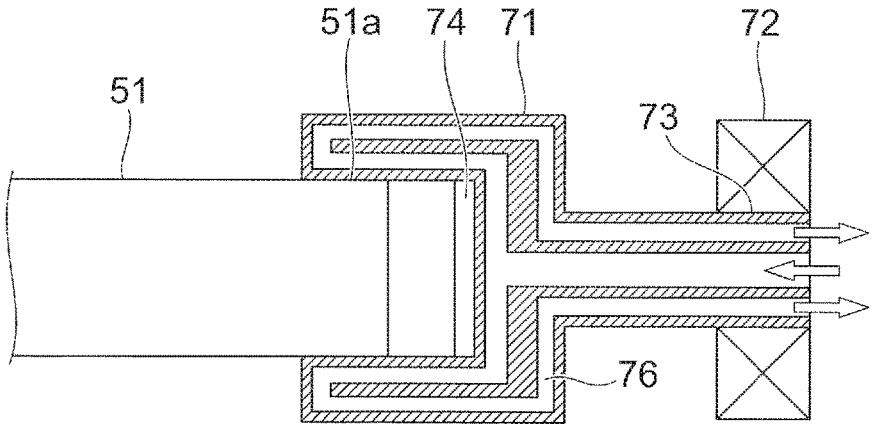
FIGS. 4A and 4B are diagrams illustrating configuration examples of periphery of an edge of a transparent rod.
Figure 4B:
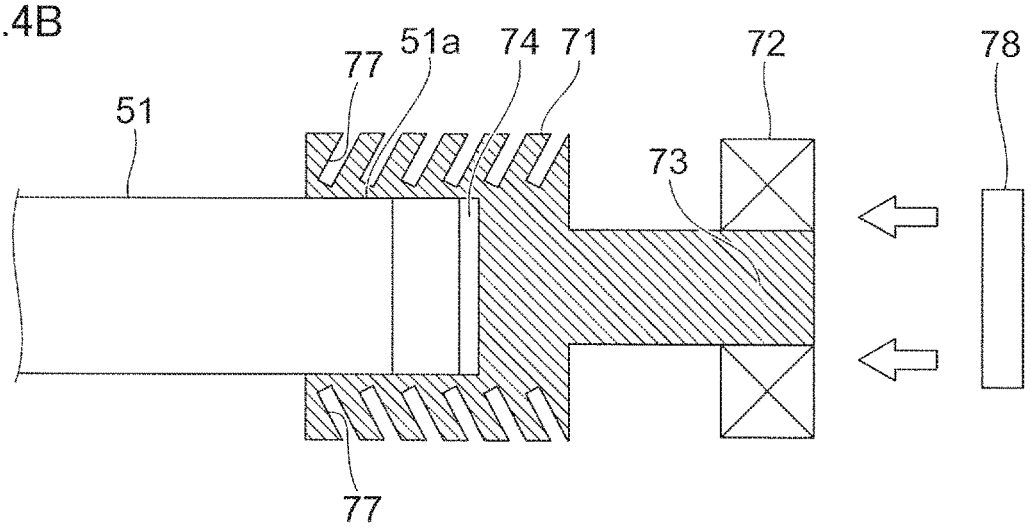

FIGS. 4A and 4B are diagrams illustrating configuration examples of periphery of the edge 51*a* of the transparent rod 51, and show only the right end portion of the transparent rod 51 in FIG. 3. FIGS. 4A and 4B show configuration examples different from each other: FIG. 4A shows a second configuration example; and FIG. 4B shows a third configuration example.

In the second configuration example shown in FIG. 4A, a chiller 76 that is a device for keeping the holding part 71 at a constant temperature is provided. Such a chiller 76 is a heat exchanger (a liquid cooler or a water cooler) that moves the heat of the light rays absorbed by the heat absorbing part 74 to the outside from the holding part 71 by a fluid. In other words, the chiller 76 is configured to include an inlet and an outlet of the fluid formed at the end portion of the operating part 73 and a flow path through which the fluid flows in one direction from the inlet to the outlet within the holding part 71 and the operating part 73. Note that, by adopting a flow path such that an inlet is formed on the center of a cross section of the holding part 71 and an outlet is formed on a peripheral side thereof, the fluid flows smoothly by using a centrifugal force in the rotation of the holding part 71.

In the second configuration example, the heat absorbing part 74 has the heat absorption function, and the chiller 76 has the cooling function. The heat absorbing part 74 and the chiller 76 are an example of the suppressing unit. The chiller 76 is an example of the ejection part.

Moreover, in the third configuration example shown in FIG. 4B, a heat dissipating part 77 that dissipates heat of the holding part 71 and an air blowing part 78 that blows air toward the heat dissipating part 77 are provided. Such a heat dissipating part 77 is configured to improve heat dissipating property by forming recessed portions on an outer surface of the holding part 71 and increasing a surface area, and the heat dissipating part 77 can also be referred to as an air cooler. The heat dissipating part 77 of the holding part 71 dissipates the heat of the light rays absorbed by the heat absorbing part 74 into the air by the wind from the air blowing part 78. Moreover, since the fixing device 50 is rotated when being operated, the heat can easily be dissipated into the air by adding an air cooling function on the surface of such a holding part 71 that is rotated and operated. In this manner, the heat of the heat absorbing part 74 is less likely to be transferred to the operating part 73 from the holding part 71. Note that a modified example in which the air blowing part 78 is omitted can be considered.

In the third configuration example, the heat absorbing part 74 has the heat absorbing function, and the heat dissipating part 77 and the air blowing part 78 have the cooling function. The heat absorbing part 74 and the heat dissipating part 77 are an example of the suppressing unit, and the heat dissipating part 77 is an example of the ejection part.

Figure 5A:
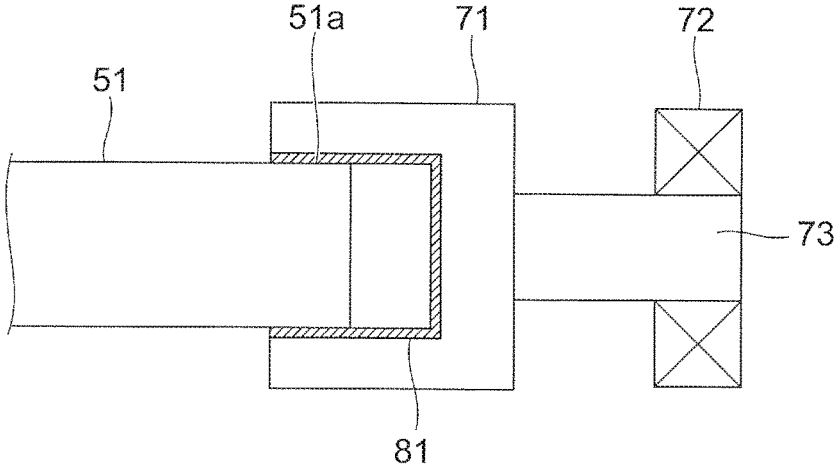
FIGS. 5A to 5C are diagrams illustrating configuration examples of periphery of the edge of the transparent rod.
Figure 5B:
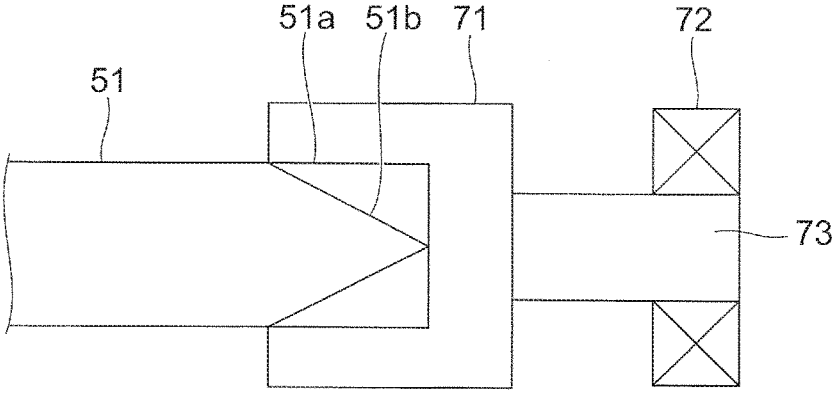
Figure 5C:
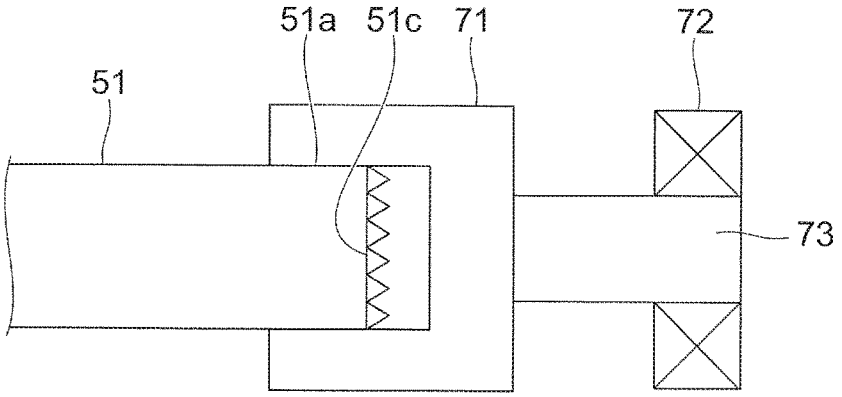

FIGS. 5A to 5C are diagrams illustrating configuration examples of periphery of the edge 51*a* of the transparent rod 51, and correspond to FIGS. 4A and 4B. FIGS. 5A to 5C show configuration examples different from one another: FIG. 5A shows a fourth configuration example; FIG. 5B shows a fifth configuration example; and FIG. 5C shows a sixth configuration example.

In the fourth configuration example shown in FIG. 5A, a reflective film 81 that reflects the light rays is formed between the transparent rod 51 and the holding part 71. Such a reflective film 81 is formed by, for example, a reflective coating. The reflective film 81 reflects the light rays reaching from the center of the transparent rod 51 to the edge 51*a* toward the center. The heat of the light rays reflected like this is removed from the inside of the transparent rod 51 by, for example, being used for fixing onto the recording material P. Note that, in the fourth configuration example, the heat absorbing part 74 (refer to FIG. 3 or FIGS. 4A and 4B), which is included in the above-described first to third configuration examples, is not provided.

In the fourth configuration example, the reflective film 81 has a function of reflecting the light rays (reflection function). The reflective film 81 is an example of the suppressing unit, and an example of the reflection part.

In the fifth configuration example shown in FIG. 5B and the sixth configuration example shown in FIG. 5C, reflective mirrors 51*b* and 51*c* that reflect the light rays are formed at the portion (end portion) of the transparent rod 51 corresponding to the holding part 71, respectively. Each of the reflective mirrors 51*b* and 51*c* is configured to include vapor-deposited metal coating and dielectric multi-layer.

The reflective mirror 51*b* in the fifth configuration example shown in FIG. 5B is a retroreflector or a corner cube, and the reflective mirror 51*c* in the sixth configuration example shown in FIG. 5C is multiple retroreflectors.

In the fifth configuration example and the sixth configuration example, the reflective mirrors 51*b* and 51*c* have the reflection function. The reflective mirrors 51*b* and 51*c* are an example of the suppressing unit, and an example of the reflection part.

The foregoing description of the present exemplary embodiment of the present invention has been provided for the purposes of illustration and description. It is not intended to be exhaustive or to limit the invention to the precise forms disclosed. Obviously, many modifications and variations will be apparent to practitioners skilled in the art. The present exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an optical system that includes a lens serving as a light guiding path and concentrates laser light for image fixing at an interface between the lens and a recording material;

a holding part that holds the lens of the optical system;

an operating part that rotates together with the holding part; and a suppressing unit that suppresses propagation of energy of the laser light from the holding part to the operating part.

2. The fixing device according to claim 1, wherein the suppressing unit includes an ejection part that ejects heat due to the laser light in the holding part.

3. The fixing device according to claim 1, wherein the suppressing unit includes a reflection part that reflects the laser light in the holding part.

4. The fixing device according to claim 1, wherein the suppressing unit includes a reflection part that reflects the laser light to a portion of the lens held by the holding part.

5. An image forming apparatus comprising:

an image forming unit that forms an image;

a transfer unit that transfers the image formed by the image forming unit onto a recording material; and a fixing unit that fixes the image, which has been transferred onto the recording material, to the recording material, wherein the fixing unit comprises:

an optical system that includes a lens serving as a light guiding path and concentrates laser light for image fixing at an interface between the lens and the recording material;

a holding part that holds the lens of the optical system;

an operating part that rotates together with the holding part; and a suppressing unit that suppresses propagation of energy of the laser light from the holding part to the operating part.

* * * * *